US007695786B2

(12) United States Patent
Liao et al.

(10) Patent No.: US 7,695,786 B2
(45) Date of Patent: Apr. 13, 2010

(54) INFLATABLE PNEUMATIC BAG

(75) Inventors: Chian Hua Liao, Sindian (TW); Yao Sin Liao, 4F., No. 7, Lane 130, Mincyuan Rd., Sindian City, Taipei County (TW); Bo Xin Jian, Sindian (TW)

(73) Assignee: Yao Sin Liao, Taipei County (TW)

( * ) Notice: Subject to any disclaimer, the term of this patent is extended or adjusted under 35 U.S.C. 154(b) by 303 days.

(21) Appl. No.: 11/566,810

(22) Filed: Dec. 5, 2006

(65) Prior Publication Data

US 2008/0005846 A1 Jan. 10, 2008

(30) Foreign Application Priority Data

Jul. 7, 2006 (TW) ..... 95124842 A

(51) Int. Cl.
*B65D 30/24* (2006.01)

(52) U.S. Cl. ..... 428/34.1; 383/44; 206/522

(58) Field of Classification Search ..... 428/34.1; 383/44, 852, 855; 206/522
See application file for complete search history.

(56) References Cited

FOREIGN PATENT DOCUMENTS

| | | | |
|---|---|---|---|
| JP | 01-045277 | A | 2/1989 |
| JP | 01-199857 | A | 8/1989 |
| JP | 06-067370 | U | 9/1994 |
| JP | 08-282736 | A | 10/1996 |
| JP | 09-042500 | A | 2/1997 |
| JP | 09-086566 | A | 3/1997 |
| JP | 10-000706 | | 1/1998 |
| JP | 2000-079951 | A | 3/2000 |
| JP | 2001-039474 | A | 2/2001 |
| JP | 2002-037341 | A | 2/2002 |
| JP | 2002-234577 | A | 8/2002 |
| JP | 2004-306407 | A | 11/2004 |
| JP | 2006-069621 | A | 3/2006 |

*Primary Examiner*—Alexander Thomas
(74) *Attorney, Agent, or Firm*—Rabin & Berdo, P.C.

(57) ABSTRACT

An inflatable pneumatic bag includes two outer films up-down stacked, and two inner films located between them. By thermal-sealing means, an interval line is formed between upsides and downsides of the two inner films, while a pneumatic passage is formed between the upsides of the two inner films and the interval line. Air tubes are formed between downsides of the two outer films and the interval line, while the two inner films are bonded at the interval line to form air ingress for connecting through the pneumatic passage and the air tube. After thermal-sealing upsides of the two outer films and the interval line, a buffer space is formed between the outer films and the two films. When the air of the air tube is leaking to the buffer space, the air of the buffer space will press the inner films to seal the pneumatic passage and prevent from leaking.

16 Claims, 12 Drawing Sheets

INFLATABLE PNEUMATIC BAG

BACKGROUND OF THE INVENTION

1. Field of Invention

The present invention relates to an inflatable pneumatic bag, and more particularly, to an inflatable pneumatic bag with enhanced airtight capability.

2. Related Art

Nowadays air bubble sheets or polystyrene are widely used to wrap articles first and then load into a cardboard box to prevent the articles from impact during transportation. However, even with the air bubble sheets firmly bonded on the surfaces of the wrapped articles, the buffering effect is not satisfied. Polystyrene has a fluffy volume occupying large spaces. And besides poor microorganism-decomposed capability, polystyrene endangers humans and causes serious environment pollution with poison gas generated from incineration process. To solve the drawbacks of the air bubble sheets and polystyrene, an air-packing bag made of resin films is developed. It includes air tubes formed by thermal-sealing, and a pneumatic hole for filling air. After air is filled into the air tube through the pneumatic hole, the air-packing bag may be used as a buffer material of internal packing.

Please refer to FIG. 1, which is an explanatory diagram for an air-packing bag in the prior art before filling air; FIG. 2 shows a cross-sectional view after filling air. The air-packing bag includes two up-down stacked outer films 21*a* and 21*b*, bonded through thermal-sealing means to form a bag body, and then a pneumatic passage 22 and a air tube 23 are made by thermal-sealing means as well. Between the two outer films 21*a* and 21*b*, thermal-sealed spots 24*a*, 24*b*, 24*c*, 24*d* are utilized to attach with two inner films 25*a* and 25*b*. With the two inner films 25*a* and 25*b* bonded laterally to the outer film 21*a*, but with the two inner films 25*a* and 25*b* not attaching to each other, a air ingress 26 is formed therein. When the air of the pneumatic passage 22 flows through the air ingress 26 to the air tube 23 to make the pneumatic passage 22 expanded, the air in the air tube 23 will press the two inner films 25*a* and 25*b* to seal the air tube 23 for preventing the air in the air tube 23 from leaking out; for example, Japan Patent Publication No. 10-000706 "Manufacture of Synthetic Resin Bag with Check Valve".

After said type of air-packing bag has been filled with air for a duration, the air in the air tube 23 will press the thermal-sealed spot 24*b* and loose off gradually, thereby generating gaps between the two outer films 21*a*, 21*b* and the two inner films 25*a*, 25*b*. Then the air in the air tube 23 will flow to the pneumatic passage 22 through the gaps generated by the loosing-off of the thermal-sealed spot 24*b*, leak out via the pneumatic passage 22 and make the air-packing bag malfunction. Therefore, improving the structure of the air-packing bag, to prevent from the drawbacks of poor buffering effects that the air in the air tube leaks out when the thermal-sealed spot is loosing off by air pressing, and to extend the usage lifetime of the air-packing bag, becomes an issue that the inventor of the present invention and those practicing in the art are eager to develop.

SUMMARY OF THE INVENTION

Accordingly, the present invention provides an inflatable pneumatic bag with enhanced airtight capability. The inflatable pneumatic bag includes two outer films up-down stacked, and two outer films located between the two inner films. By way of thermal-sealing means, an interval line is formed between upsides and downsides of the two inner films, while a pneumatic passage is formed between the upsides of the two inner films and the interval line. At least one air tube is formed between downsides of the two outer films and the interval line, while the two inner films are bonded at the interval line to form at least one air ingress for connecting through the pneumatic passage and the air tube. After thermal-sealing upsides of the two outer films and the interval line, a buffer space is formed between the two outer films and the two inner films.

The present invention also discloses an inflatable pneumatic bag with enhanced airtight capability, which includes an upper film and a lower film up-down stacked, and an inner film located between the upper film and the lower film. By way of thermal-sealing means, an upside and a downside of the inner film is thermal-sealed to form an interval line, and then a pneumatic passage is formed by thermal-sealing and attaching the inner film and the upper film between the upsides of the upper film and the interval line. A air tube is formed between the interval line and the downsides of the upper film and the lower film by thermal sealing as well. The inner film and the upper film are then thermal sealed at the interval line to form at least one air ingress, thereby connecting through the pneumatic passage and the air tube. By thermal-sealing between the upside of the lower film and the interval line, a buffer space is formed between the inner film and the lower film.

The inflatable pneumatic bag with enhanced airtight capability of the present invention utilizes the air filled in the pneumatic passage, opening the air ingress and entering the air tube, to make the air tube expansive with filled air. When the air of the air tube leaks out to the buffer space, the air of the buffer space will press the inner film to seal the pneumatic passage and prevent the air from leaking out through the pneumatic passage. Not only the buffering effect is enhanced while using the inflatable pneumatic bag, but also the usage lifetime of the inflatable pneumatic bag may be extended.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF THE INVENTION

Figure 1:
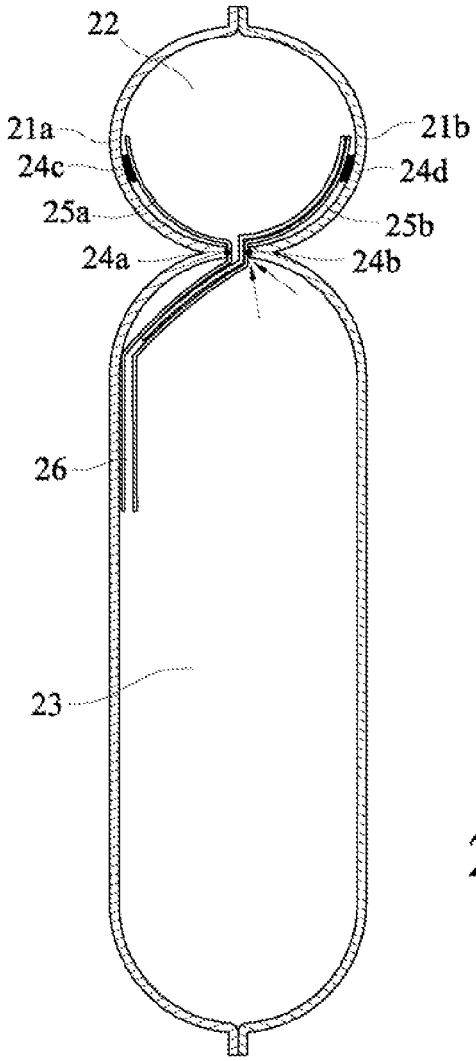
FIG.1 (PRIOR ART)
FIG. 1 is an explanatory diagram of an air-packing bag in the prior art before filling air.
Figure 2:
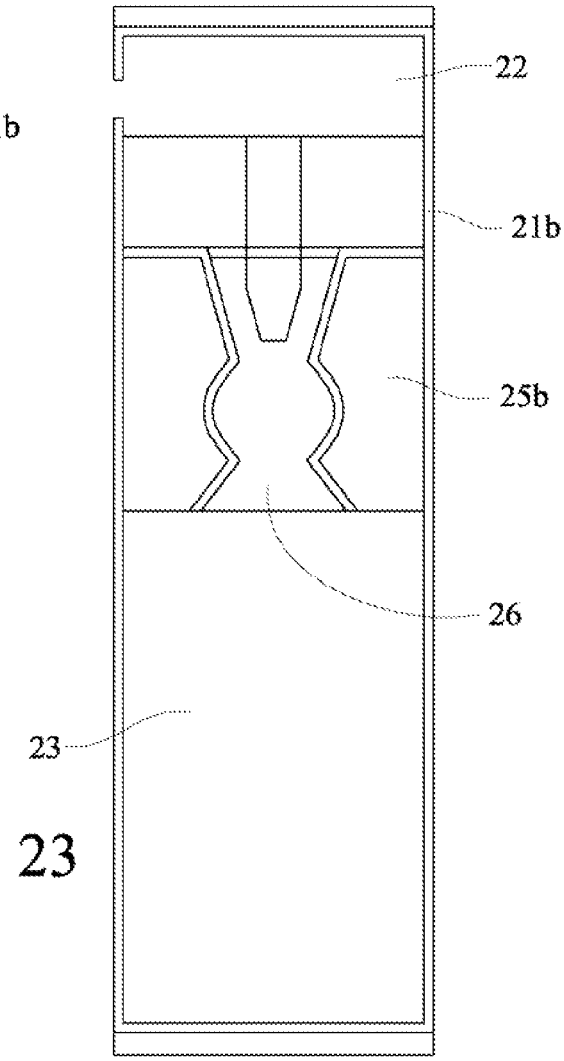
FIG.2 (PRIOR ART)
FIG. 2 is an explanatory diagram of the air-packing bag in the prior art after filling air.
Figure 3A:
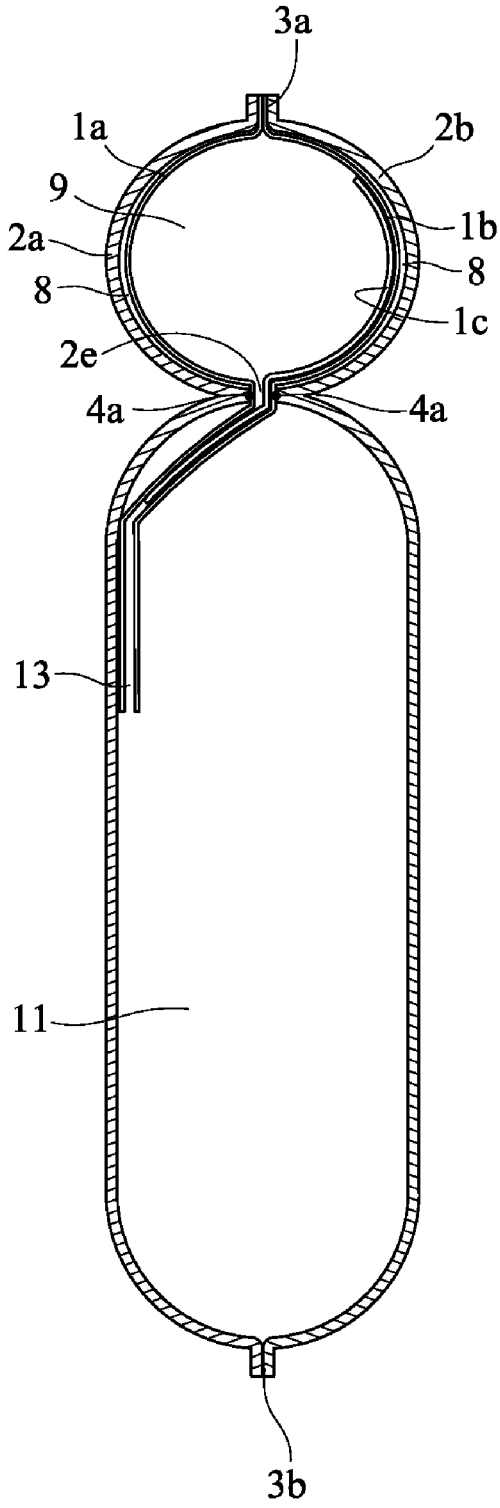
FIG. 3A is a cross-sectional view for an inflatable pneumatic bag of dual-piece wall-attaching type after filling air.
Figure 3B:
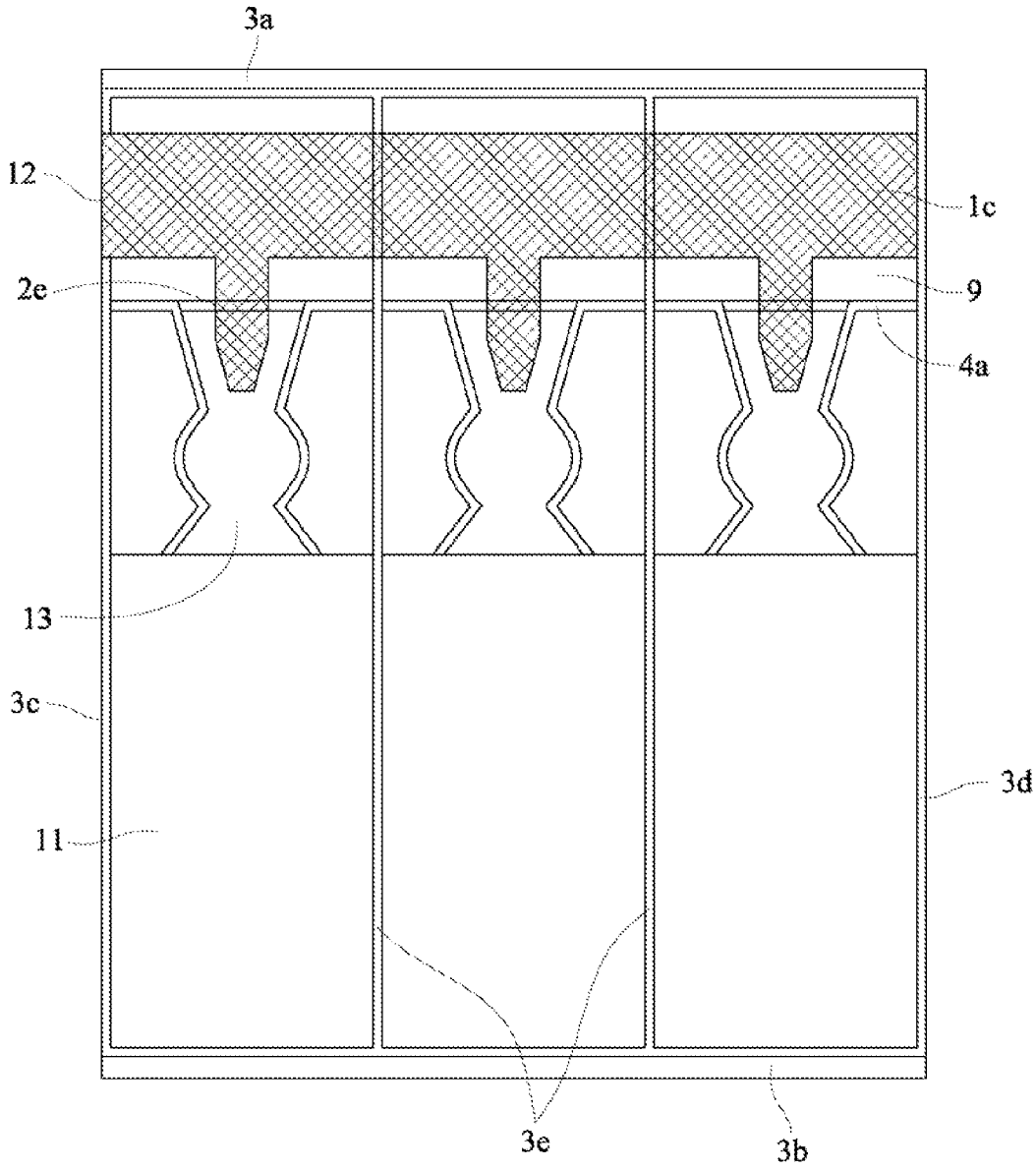
FIG. 3B is a plane view for the inflatable pneumatic bag of dual-piece wall-attaching type before filling air.
Figure 3C:
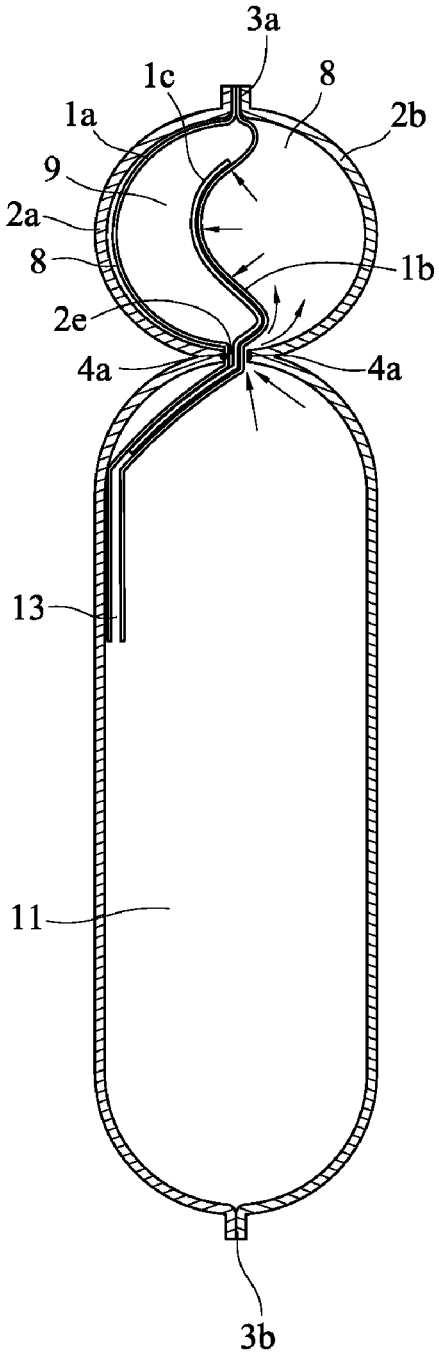
FIG. 3C is a cross-sectional view for a air tube of the inflatable pneumatic bag of dual-piece wall-attaching type while leaking air.

Please refer to FIGS. 3A, 3B and 3C, which illustrate an inflatable pneumatic bag of dual-piece wall-attaching type. FIG. 3A shows a cross-sectional view after filling air. FIG. 3B shows a plane view before filling air. FIG. 3C shows a cross-sectional view of the air tube while leaking air.

The inflatable pneumatic bag with enhanced airtight capability includes two outer films 2*a*, 2*b*, two inner films 1*a*, 1*b*, a pneumatic passage 9, a air tube 11 and air ingress 13.

The two outer films 2*a*, 2*b* are up-down stacked.

The two inner films 1*a*, 1*b* attach laterally to the outer film 2*a* or 2*b*. Between the two inner films 1*a*, 1*b*, heatproof material 1*c* is applied therein to be utilized as a passage for air flow.

By way of thermal-sealing means, thermal-seal along the thermal-sealed lines 3*a*, 3*b*, 3*c*, 3*d*, 3*e*, and thermal-seal between the upsides and downsides of the two inner films 1*a*, 1*b* to form interval lines 4*a*, thereby coupling the two outer films 2*a*, 2*b* and the two inner films 1*a*, 1*b* to form a pneumatic passage 9 between the upsides of the two inner films 1*a*, 1 *b* and the interval lines 4*a*. The pneumatic passage 9 passes through the thermal-sealed lines 3*e*, with a pneumatic hole 12 connecting to external air. The thermal-sealing means may be thermal mold pressing.

After thermal-sealing by thermal-sealing means, the air tube 11 for storing air may be formed between the downsides of the two outer films 2*a*, 2*b* and the interval lines 4*a*. Buffer spaces 8 for storing air may also be formed between the upsides of the two outer films 2*a*, 2*b* and the interval lines 4*a*.

The heatproof material 1*c* is applied at intervals between the two inner films 1*a*, 1*b* in sequence. For example, print thermal glue or ink by printing means. Through thermal-sealing means, the two inner films 1*a*, 1*b* will not attach to each other to form a air ingress 13. At one side of the air ingress 13, an input hole 2*e* is formed. The width of the terminal of the air ingress 13 connecting with the input hole 2*e*, is greater than the other terminal. And the air pressure of the air ingress 13 at the curve portion is greater than the two sides. Therefore, the air is easy to enter the input hole 2*e* but difficult to leak out, which will achieve good airtight effects when the inner pressure of the air tube 11 is increasing to press the curve portion of the air ingress 13 tightly.

The air that enters the pneumatic hole 12 expands the pneumatic passage 9, along with the two inner films 1*a*, 1*b* pressed externally to open the input hole 2*e*, thereby enabling the air in the pneumatic passage 9 to fill and expand the air tube 11. The inner pressure of the air in the air tube 11 will then press the two inner films 1*a*, 1*b* to attach to the outer film 2*a* or 2*b* tightly, covering the air ingress 13, sealing the air tube 11, and then reaching airtight effects without gas leaking.

The inner pressure of the air in the air tube 11 will lose out the interval lines 4*a*, 4*a* gradually, which causes the air of the air tube 11 to flow through the gaps between the interval lines 4*a* and leak out. When the air in the air tube 11 leaks out to the buffer spaces 8, the inner pressure of the air in the buffer spaces 8 will press the two inner films 1*a*, 1*b* to seal the pneumatic passage 9 and prevent the air from leaking out through the pneumatic passage 9. This will not only raise the buffering effects while using the inflatable pneumatic bag, but also effectively extend the usage lifetime of the inflatable pneumatic bag.

Figure 4A:
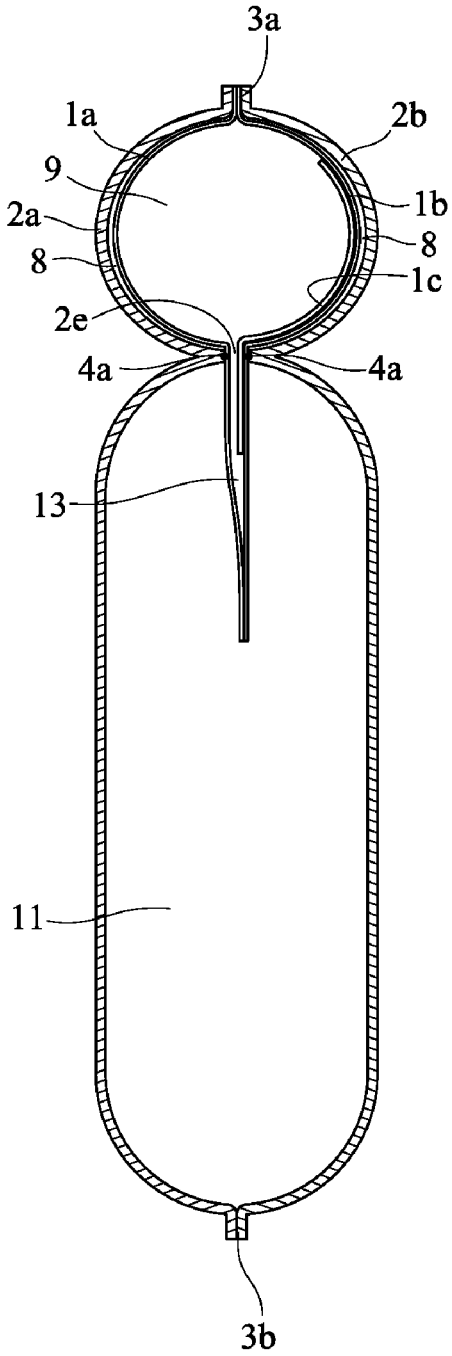
FIG. 4A is a cross-sectional view for an inflatable pneumatic bag of dual-piece wall-hanging type after filling air.
Figure 4B:
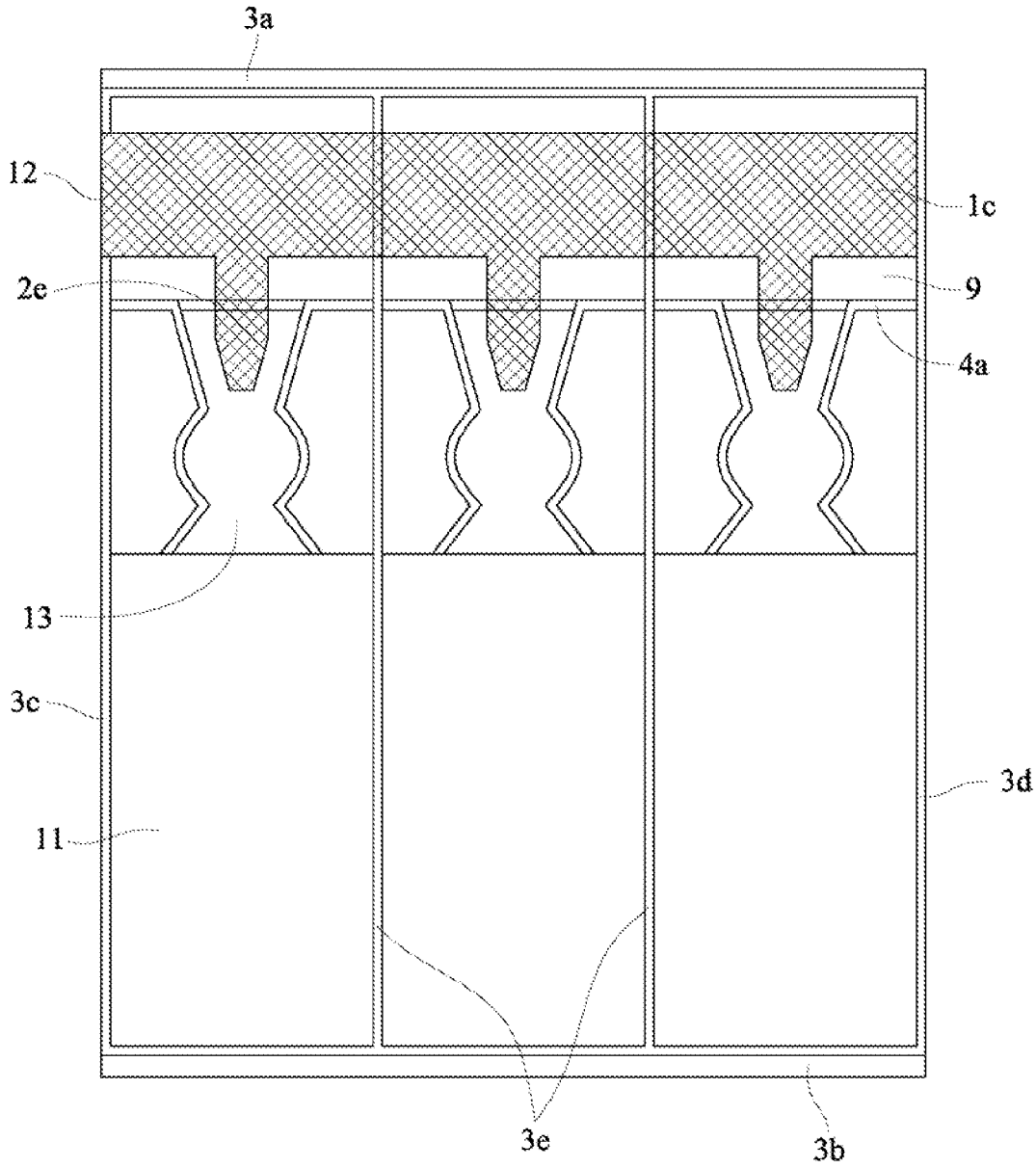
FIG. 4B is a plane view for the inflatable pneumatic bag of dual-piece wall-hanging type before filling air.
Figure 4C:
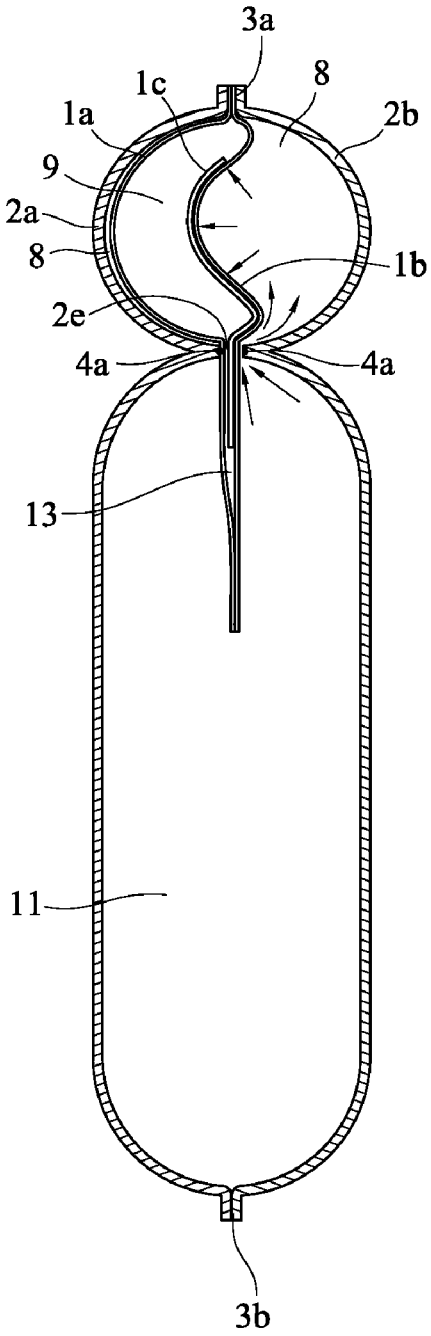
FIG. 4C is a cross-sectional view for a air tube of the inflatable pneumatic bag of dual-piece wall-hanging type while leaking air.

Please refer to FIGS. 4A, 4B and 4C, which illustrate an inflatable pneumatic bag of dual-piece wall-hanging type. FIG. 4A shows a cross-sectional view after filling air. FIG. 4B shows a plane view before filling air. FIG. 4C shows a cross-sectional view of the air tube while leaking air.

The inflatable pneumatic bag has the two inner films 1*a*, 1*b* configured between the two outer films 2*a* or 2*b*, and the two inner films 1*a*, 1*b* do not attach to the outer film 2*a* or 2*b* to form an inflatable pneumatic bag of dual-piece wall-hanging type. Except that the two inner films 1*a*, 1*b* do not attach to the outer film 2*a* or 2*b*, the rest of structure features are the same as the inflatable pneumatic bag of dual-piece wall-attaching type.

The upsides of aforesaid two inner films 1*a*, 1*b* and the upsides of aforesaid two outer films 2*a*, 2*b* may be thermal-sealed by thermal-sealing means, to form a buffer space 8 between the two inner films 1*a*, 1*b* and the two outer films 2*a*, 2*b*. The upsides of the two inner film 1*a*, 1*b* and the upsides of the two outer film 2*a*, 2*b* may aligned together, with thermal-sealing the two inner film 1*a*, 1*b* and the two outer film 2*a*, 2*b* by thermal-sealing means, to form two buffer spaces 8 between the two inner films 1*a*, 1*b* and the two outer films 2*a*, 2*b*.

In addition, the two outer films 2*a*, 2*b* are formed with plural air tubes 11 of the same size through attaching to each other with equal intervals by thermal-sealing means. Even plural air tubes 11 of various sizes may be formed through attaching with unequal intervals.

Figure 5A:
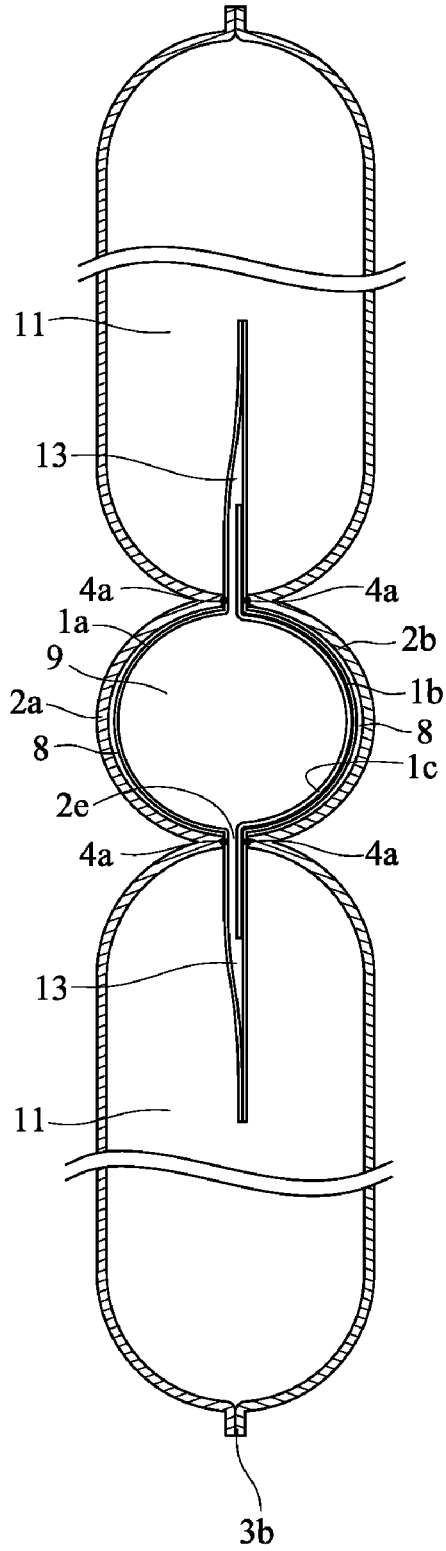
FIG. 5A is a cross-sectional view for an inflatable pneumatic bag of another dual-piece wall-attaching type after filling air.
Figure 5B:
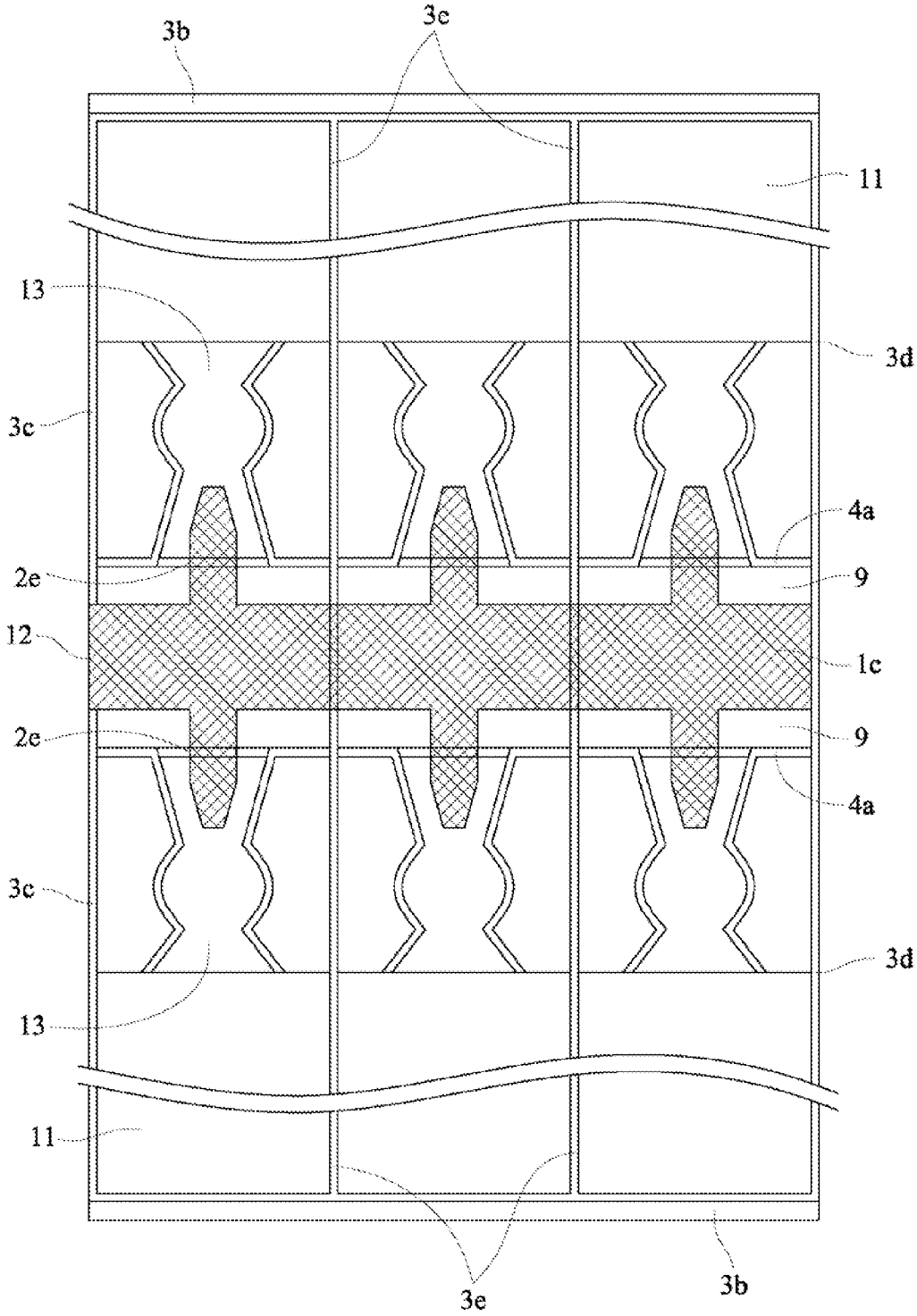
FIG. 5B is a plane view for the inflatable pneumatic bag of another dual-piece wall-attaching type before filling air.
Figure 5C:
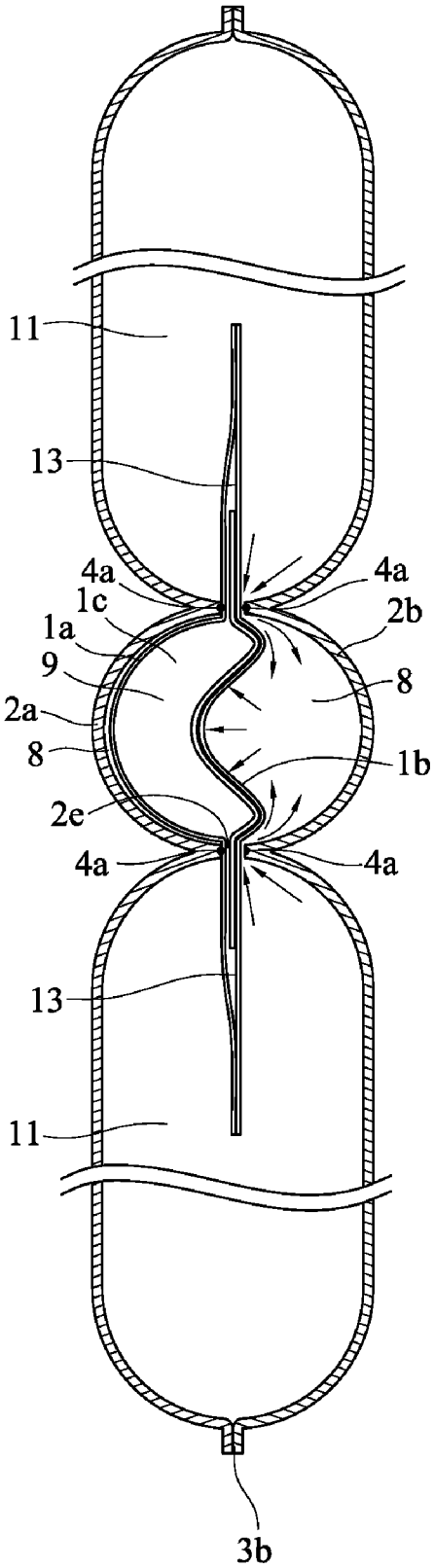
FIG. 5C is a cross-sectional view for an air tube of the inflatable pneumatic bag of another dual-piece wall-attaching type while leaking air.
Figure 6A:
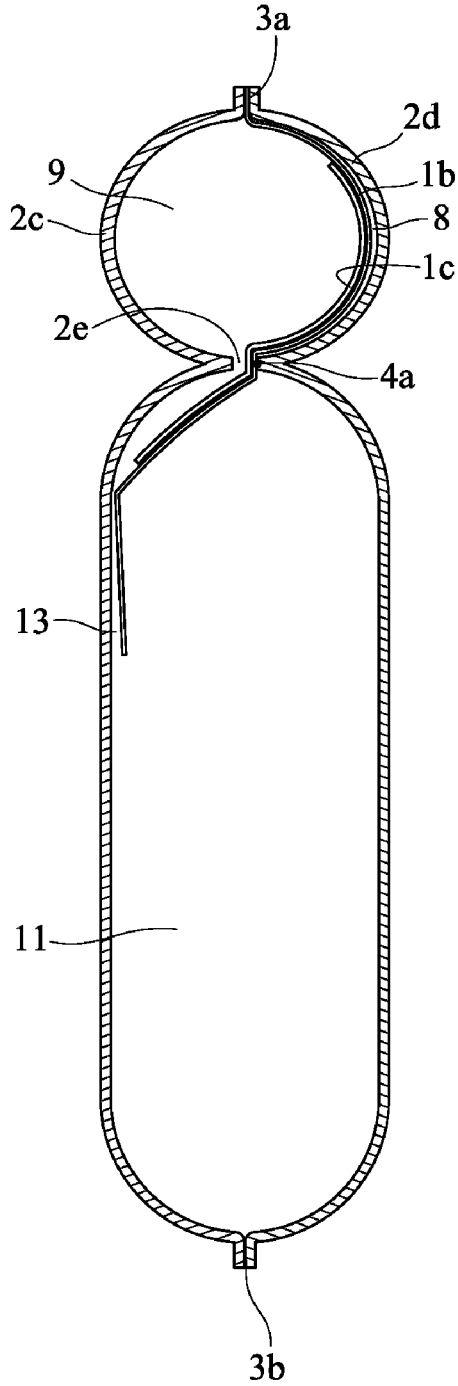
FIG. 6A is a plane view for the inflatable pneumatic bag of single-piece wall-attaching type after filling air.
Figure 6B:
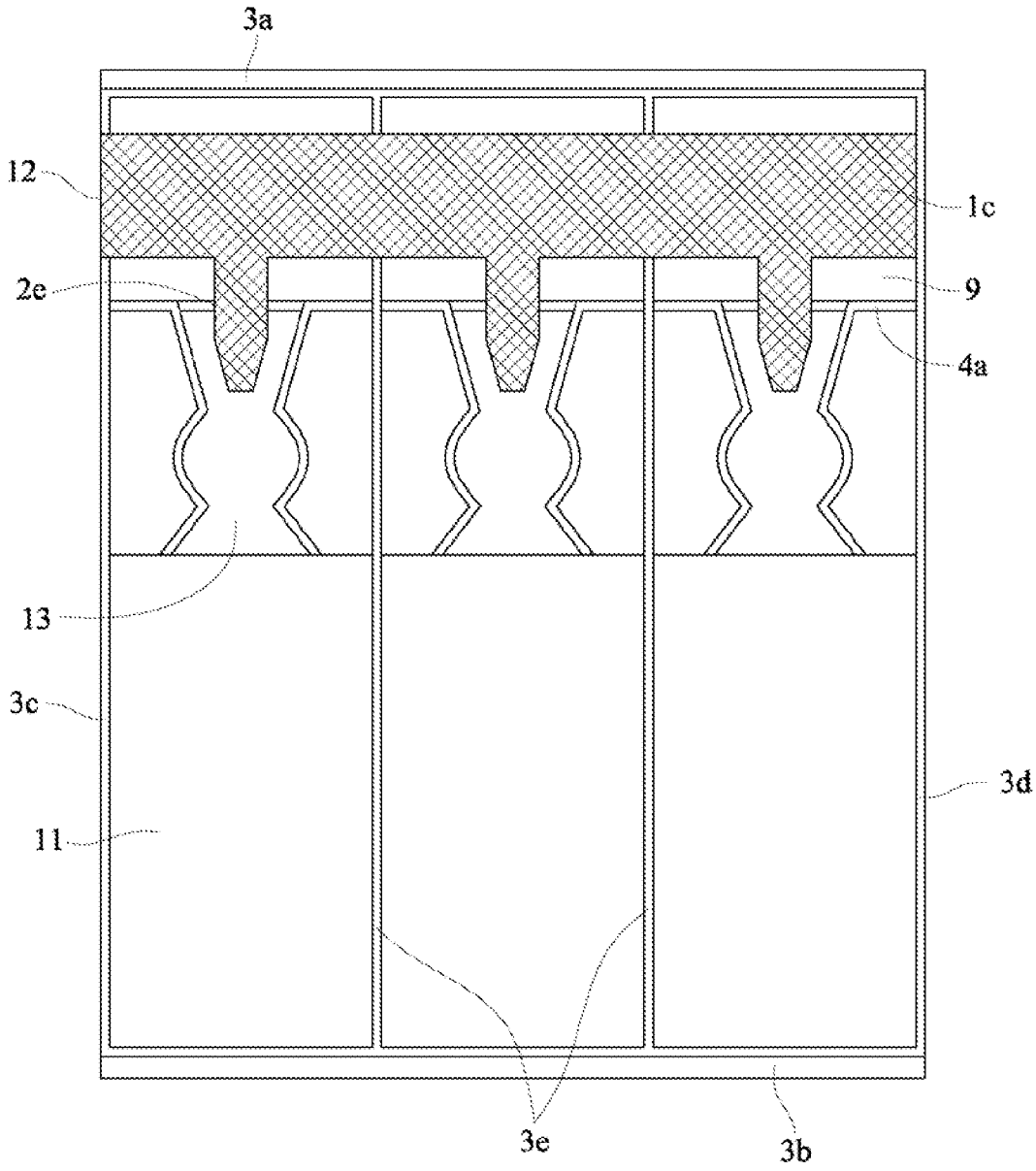
FIG. 6B is a plane view for the inflatable pneumatic bag of single-piece wall-attaching type before filling air.
Figure 6C:
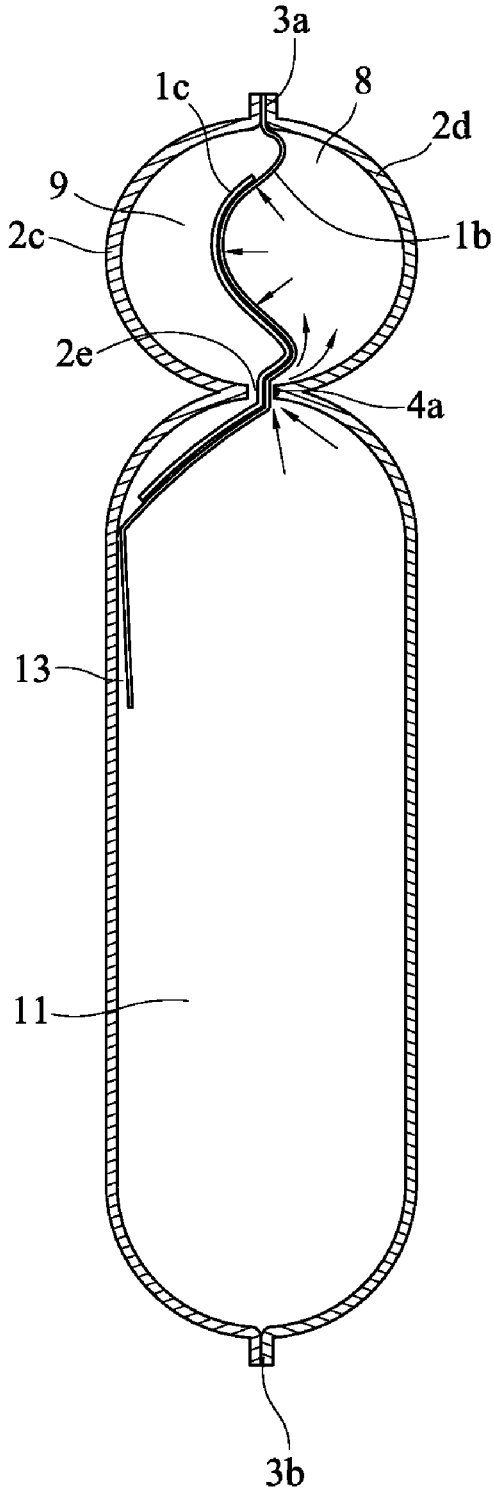
FIG. 6C is a cross-sectional view for an air tube of the inflatable pneumatic bag of single-piece wall-attaching type while leaking air.

Please refer to FIGS. 5A, 5B and 5C, which illustrate an inflatable pneumatic bag of another dual-piece wall-attaching tyre. FIG. 5A shows a cross-sectional view after filling air. FIG. 5B shows a plane view before filling air. FIG. 5C shows a cross-sectional view of the air tube while leaking air. By way of thermal-sealing means, thermal-seal along the thermal-sealed lines 3*a*, 3*b*, 3*c*, 3*d*, 3*e*, and thermal-seal between the upsides and downsides of the two inner films 1*a*, 1*b* to form the interval lines 4*a*, thereby coupling the two outer films 2*a*, 2*b* and the two inner films 1*a*, 1*b* to form the pneumatic passage 9 between the upsides of the two inner films 1*a*, 1*b* and the interval lines 4*a*. After thermal-sealing by thermal-sealing means, the two outer films 2*a*, 2*b* form the air tube 11 for storing air may at the two ends of the pneumatic passage 9. The buffer spaces 8 for storing air may also be formed between the upsides of the two outer films 2*a*, 2*b* and the interval lines 4*a*. The inner pressure of the air in the air tube 11 will lose out the interval lines 4 gradually, which causes the air of the air tube 11 to flow through the gars between the interval lines 4*a* and leak out. When the air in the air tube 11 leaks out to the buffer spaces 8, the inner pressure of the air in the buffer spaces 8 will press the two inner films 1*a*, 1*b* to seal the pneumatic passage 9 and prevent the air from leaking out through the pneumatic passage 9. Please refer to FIGS. 6A, 6B and 6C, which illustrate an inflatable pneumatic bag of single-piece wall-attaching type. FIG. 6A shows a cross-sectional view after filling air. FIG. 6B shows a plane view before filling air. FIG. 6C shows a cross-sectional view of the air tube while leaking air.

The inflatable pneumatic bag with enhanced airtight capability includes an upper film 2*c*, a lower film 2*d*, an inner film 1*b*, a pneumatic passage 9, a air tube 11 and an air ingress 13.

The upper film 2*c* and the lower film 2*d* are up-down stacked.

The inner film 1*b* is located between the upper film 2*c* and the lower film 2*d*. The upsides of the inner film 1*b* and the upsides of the upper film 2*c* are assigned together. Between the inner film 1*b* and the upper film 2*c*, heatproof material 1*c* is applied therein to be utilized as a passage for air flow.

By way of thermal-sealing means, thermal-seal along the thermal-sealed lines 3*a*, 3*b*, 3*c*, 3*d*, 3*e*, and thermal-seal between the upside and downside of the inner film 1*b* to form an interval line 4*a*, thereby coupling the inner film 1*b*, the upper film 2*c* and the lower film 2*d* to form the pneumatic passage 9 between the upside of the upper film 2*c* and the interval line 4*a*. The pneumatic passage 9 passes through the thermal-sealed lines 3*e*, with a pneumatic hole 12 connecting to external air. The thermal-sealing means may be thermal mold pressing.

After thermal-sealing by thermal-sealing means, the air tube 11 for storing air may be formed between the downsides of the upper film 2*c* and the lower film 2*d* and the interval line 4*a*. A buffer space 8 for storing air is formed between the upsides of the upper film 2*c* and the lower film 2*d* and the interval lines 4*a*.

The heatproof material 1*c* is applied at intervals between the inner film 1*b* and the upper film 2*c* in sequence. For example, print thermal glue or ink by printing means. Through thermal-sealing means, the inner film 1*b* and the upper film 2*c* will not attach to each other to form an air ingress 13. At one side of the air ingress 13, an input hole 2*e* is formed. The width of the terminal of the air ingress 13 connecting with the input hole 2*e*, is greater than the other terminal. And the air pressure of the air ingress 13 at the curve portion is greater than the two sides. Therefore, the air is easy to enter the input hole 2*e* but difficult to leak out, which will achieve good airtight effects when the inner pressure of the air tube 11 is increasing to press the curve portion of the air ingress 13 tightly.

The air that enters the pneumatic hole 12 expands the pneumatic passage 9, with the inner film 1*b* pressed externally to open the input hole 2*e*, thereby enabling the air in the pneumatic passage 9 to fill and expand the air tube 11 with filled air. The inner pressure of the air in the air tube 11 presses the inner film 1*b* to attach to the upper film 2*c* tightly, covering the air ingress 13 and sealing the air tube 11, thereby reaching good airtight effects without leaking air.

The inner pressure of the air in the air tube 11 will loose out the interval line 4*a* gradually, which causes the air in the air tube 11 to pass through the gaps of the interval lines 4*a* and leak out. After the air of the air tube 11 leaks out to the buffer space 8, the inner pressure of the air in the buffer space 8 will press the inner film 1*b* to attach to the upper film 2*c* tightly, thereby sealing the pneumatic passage 9 to prevent the air from leaking out through the pneumatic passage 9. This is not only to raise the buffering effects while using the inflatable pneumatic bag, but also to extend effectively the usage lifetime of the inflatable pneumatic bag.

The aforesaid upper film 2*c* and the lower film 2*d* are formed with plural air tubes 11 of the same size through attaching to each other with equal intervals by thermal-sealing means. Even plural air tubes 11 of various sizes may be formed through attaching with unequal intervals.

Figure 7A:
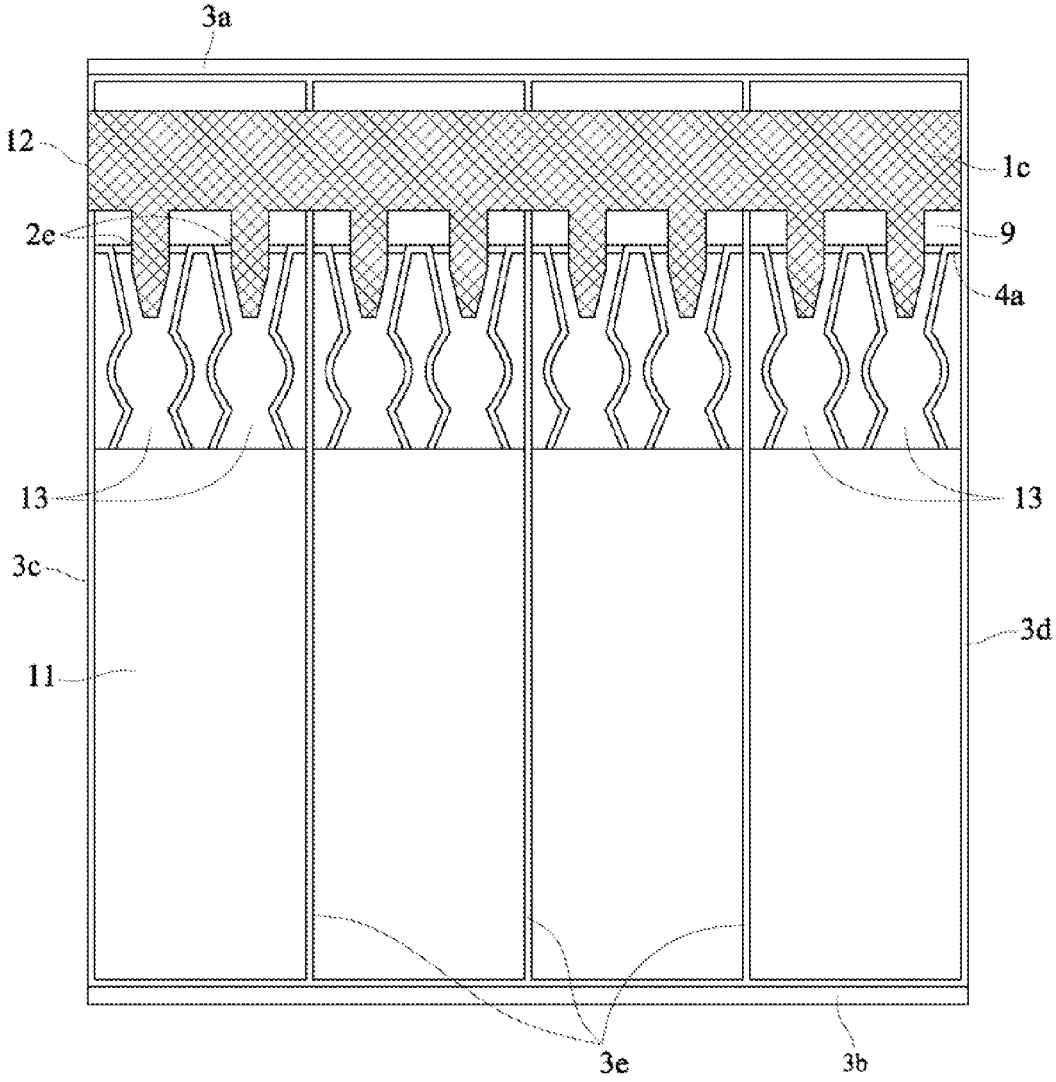
FIG. 7A shows the first plane view of an inflatable pneumatic bag formed with multiple input holes before filling air.
Figure 7B:
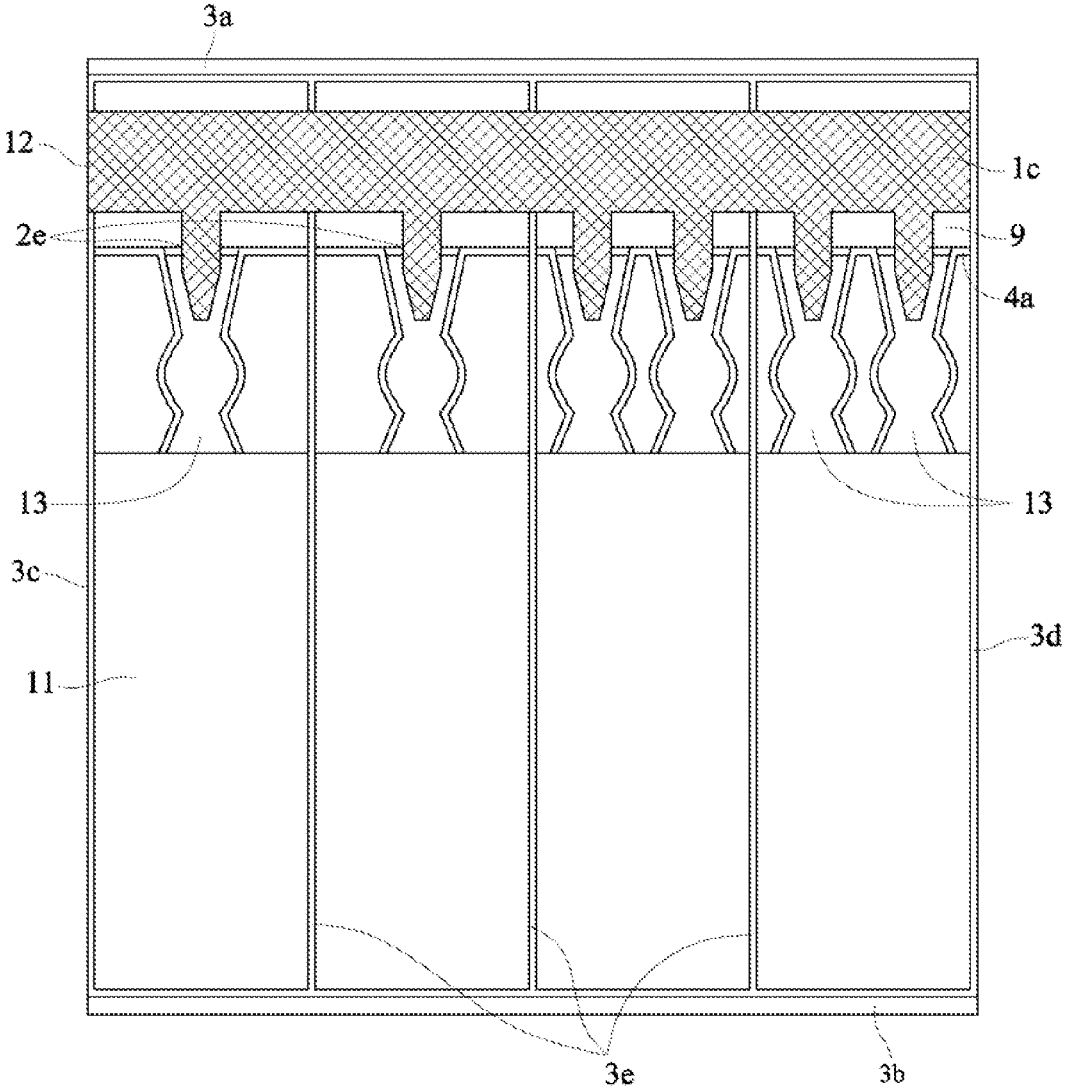
FIG. 7B shows the second plane view of the inflatable pneumatic bag formed with multiple input holes before filling air.

Please refer to FIGS. 7A and 7B, which illustrate an inflatable pneumatic bag formed with multiple input holes. FIG. 7A shows the first plane view before filling air, while FIG. 7B shows the second plane view before filling air.

The pneumatic passage 9 of the inflatable pneumatic bag may connect with one or plural input holes 2*e*. Each of the air tubes 11 may connect with one or plural air ingress 13. Besides, the air tubes 11 may connect through each other, and further share one or plural air ingresses 13.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An inflatable pneumatic bag, comprising:

two outer films stacked on each other;

two inner films located between the two outer films;

an interval line formed by a thermal-sealing means that couples said two outer films and said two inner films;

a pneumatic passage, which located between an upper end of the two inner films and the interval line and formed by attaching the two inner films by said thermal-sealing means;

at least one air tube as space for storing air, which is located between bottom portions of the two outer films and the interval line and formed by attaching to seal bottom ends of the two outer films by thermal-sealing means;

at least one air ingress, connecting between the pneumatic passage and the air tube, which is formed by attaching to seal the two inner films at the interval line by said thermal-sealing means; and a buffer space as space for storing air, which is located between the upper end of each outer film and the interval line and is formed by using said thermal-sealing means to seal the two outer films and the two inner films;

wherein, the air of the buffer space presses the two inner films and seals the pneumatic passage to prevent leakage from the air tube into the buffer space.

2. The inflatable pneumatic bag of claim 1, wherein the upper ends of the two inner films and the two outer films are aligned together.

3. The inflatable pneumatic bag of claim 1, wherein the pneumatic passage is formed by applying a heatproof material between the two inner films and then attaching the two inner films by said thermal-sealing means.

4. The inflatable pneumatic bag of claim 1, wherein the pneumatic passage comprises a pneumatic hole for filling with external air.

5. The inflatable pneumatic bag of claim 4, wherein the air of the pneumatic hole expands the pneumatic passage to open the air ingress and enter the air tube.

6. The inflatable pneumatic bag of claim 1, wherein the air of the air tube presses the two inner films to cover the air ingress and seal the air tube.

7. The inflatable pneumatic bag of claim 1, wherein the air ingress is formed by applying with heatproof material at intervals between the two inner films in sequence, and attaching the two inner films by said thermal-sealing means.

8. The inflatable pneumatic bag of claim 1, wherein the air of the buffer space presses the two inner films to attach to one of the outer films and then seals the pneumatic passage to prevent air leakage.

9. An inflatable pneumatic bag, comprising:

an upper film;

a lower film, superposed on the upper film;

an inner film, located between the upper film and the lower film;

an interval line formed by a thermal sealing means that couples the upper film, the lower film and the inner film;

a pneumatic passage, which is located between an upper end of the upper film and the interval line and formed by attaching the inner film and the upper film by said thermal-sealing means;

at least one air tube as space for storing air, which is located between bottom portions of the upper film and the lower film and the interval line and formed by attaching to seal bottom ends of the upper film and the lower film by said thermal-sealing means;

at least one air ingress, connecting between the pneumatic passage and the air tube, which is formed by attaching to seal the inner film and the upper film at the interval line by said thermal-sealing means; and a buffer space as space for storing air, which is located between an upper end of the lower film and the interval line and formed between the inner film and the lower film by said thermal-sealing means;

wherein, the air of the buffer space presses the inner film and seals the pneumatic passage to prevent air leakage from the air tube into the buffer space.

10. The inflatable pneumatic bag of claim 9, wherein the pneumatic passage is formed through applying heatproof material between the inner film and the upper film and then attaching to seal the inner film and the upper film by said thermal-sealing means.

11. The inflatable pneumatic bag of claim 9, wherein the upper ends of the inner film, the upper film and the lower film are aligned together.

12. The inflatable pneumatic bag of claim 9, wherein the pneumatic passage comprises a pneumatic hole for filling with external air.

13. The inflatable pneumatic bag of claim 12, wherein the air of the pneumatic hole expands the pneumatic passage to open the air ingress and enter the air tube.

14. The inflatable pneumatic bag of claim 9, wherein the air of the air tube presses the inner film and covers the air ingress to seal the air tube.

15. The inflatable pneumatic bag of claim 9, wherein the air ingress is formed through applying heatproof material at intervals between the inner film and the upper film in sequence, and attaching the inner film and the upper film by said thermal-sealing means.

16. The inflatable pneumatic bag of claim 9, wherein the air of the buffer space presses the inner film to attach to the upper film tightly and then seals the pneumatic passage to prevent air leakage.

* * * * *